US011028799B2

(12) United States Patent
Reding et al.

(10) Patent No.: US 11,028,799 B2
(45) Date of Patent: Jun. 8, 2021

(54) SELECTIVE ENGINE BLOCK CHANNELING FOR ENHANCED CAVITATION PROTECTION

(71) Applicant: Deere & Company, Moline, IL (US)

(72) Inventors: Robert J. Reding, Cedar Falls, IA (US); Douglas S. Brocco, Waterloo, IA (US); Terry W. Schwickerath, Parkersburg, IA (US); Umesh A. Tol, Cedar Falls, IA (US); Craig W. Lohmann, Cedar Falls, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 16/556,936

(22) Filed: Aug. 30, 2019

(65) Prior Publication Data

US 2021/0062750 A1 Mar. 4, 2021

(51) Int. Cl.

| | |
|---|---|
| ***F02F 1/16*** | (2006.01) |
| ***F02F 1/12*** | (2006.01) |
| ***F02F 1/00*** | (2006.01) |

(52) U.S. Cl.

CPC ..... *F02F 1/12* (2013.01); *F02F 1/004* (2013.01); *F02F 1/16* (2013.01)

(58) Field of Classification Search

CPC ..... F02F 1/12; F02F 1/004; F02F 1/10; F02F 1/16; F02F 1/163; F02F 1/166

See application file for complete search history.

(56) References Cited

U.S. PATENT DOCUMENTS

| | | | | |
|---|---|---|---|---|
| 5,537,969 | A | 7/1996 | Hata et al. | |
| 5,979,374 | A | 11/1999 | Jackson | |
| 6,298,818 | B1 | 10/2001 | Koyama et al. | |
| 6,675,750 | B1 * | 1/2004 | Wagner | F02F 1/14 123/41.79 |
| 9,017,823 | B2 | 4/2015 | Liu et al. | |
| 2006/0249105 | A1 | 11/2006 | Azevedo | |
| 2010/0206261 | A1 | 8/2010 | Berghian et al. | |
| 2019/0093542 | A1 | 3/2019 | Palmisani et al. | |

OTHER PUBLICATIONS

German Search Report issued in counterpart application No. 102020209721.6 dated Mar. 31, 2021 (10 pages).

* cited by examiner

*Primary Examiner* — Jacob M Amick
(74) *Attorney, Agent, or Firm* — Klintworth & Rozenblat IP LLP

(57) ABSTRACT

An anti-cavitation engine block includes a first cylinder having a first cylinder centerline, a second cylinder having a second cylinder centerline, and a first inter-cylinder wall section located between the first cylinder and the second cylinder along an axis perpendicular to the first and second cylinder centerlines. A first plurality of anti-cavitation channels is formed in the first inter-cylinder wall section. A cylinder liner is inserted into the first cylinder and has an outer circumferential surface toward which the first plurality of anti-cavitation channels open. A water jacket extends at least partially around the outer circumferential surface of the cylinder liner. The first plurality of anti-cavitation channels increase local radial thicknesses of the water jacket to deter cavitation within the water jacket and adjacent the cylinder liner during engine operation.

18 Claims, 10 Drawing Sheets

SELECTIVE ENGINE BLOCK CHANNELING FOR ENHANCED CAVITATION PROTECTION

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to engine blocks having anti-cavitation channels (herein, "anti-cavitation engine blocks") and to engine block assemblies containing anti-cavitation engine blocks.

BACKGROUND OF THE DISCLOSURE

Water jackets are commonly utilized for thermal regulation in liquid-cooled internal combustion engines, including diesel engines onboard tractors and other work vehicles. About their inner peripheries, the water jackets are bound by cylinder sleeves or liners inserted into one or more banks of cylinders provided in the engine block body. About their outer peripheries, the water jackets are bound by the inner walls of the engine block, which define the cylinders. During operation of the liquid-cooled engine, a pump circulates a liquid coolant (typically water admixed with antifreeze, corrosion inhibitors, or other additives) through the water jackets. The liquid coolant may be drawn from upper regions of the water jackets, directed through a radiator (or other heat exchanger) to transfer heat from the coolant to the ambient environment, filtered, and then reinjected into lower regions of the water jackets in a reduced temperature state. By actively circulating a liquid coolant through the water jackets in this manner, excess heat is removed from the cylinder liners, the cylinder heads, and other regions of the engine to prolong engine component lifespan and boost overall engine performance.

SUMMARY OF THE DISCLOSURE

Engine block assemblies including anti-cavitation engine blocks and utilized within liquid-cooled engines are disclosed. In embodiments, the anti-cavitation engine block contains a first cylinder having a first cylinder centerline, a second cylinder having a second cylinder centerline, and a first inter-cylinder wall section. The first inter-cylinder wall section is located between the first cylinder and the second cylinder, as taken along a longitudinal axis perpendicular to the first and second cylinder centerlines. A first plurality of anti-cavitation channels is formed in the first inter-cylinder wall section, while a cylinder liner is inserted into the first cylinder. The cylinder liner has an outer circumferential surface toward which the first plurality of anti-cavitation channels open. A water jacket extends at least partially around the outer circumferential surface of the cylinder liner. The first plurality of anti-cavitation channels increases local radial thicknesses of the water jacket to deter cavitation within the water jacket and adjacent the cylinder liner during operation of the liquid-cooled engine.

In further embodiments, the engine block assembly includes an anti-cavitation engine block utilized within a liquid-cooled engine. A plurality of cylinders is formed in the anti-cavitation engine block and is spaced along a longitudinal axis perpendicular to centerlines of the cylinders. The anti-cavitation engine block further include inner block walls, which bound outer peripheries of the cylinders. Cylinder liners are inserted into the plurality of cylinders and have targeted surface regions prone to cavitation damage during operation of the liquid-cooled engine. Anti-cavitation channels are cut into the inner block walls at locations adjacent the targeted surface regions of the cylinder liners.

Anti-cavitation engine blocks utilized within liquid-cooled engines are further disclosed. In embodiments, the anti-cavitation engine block includes a first cylinder having a first cylinder centerline, a second cylinder having a second cylinder centerline, and a first inter-cylinder wall section. The inter-cylinder wall section is located between the first cylinder and the second cylinder, as taken along a longitudinal axis perpendicular to the first cylinder centerline and to the second cylinder centerline. A first plurality of anti-cavitation channels is formed in the first inter-cylinder wall section. The first plurality of anti-cavitation channels increases local thicknesses of a water jacket to deter cavitation within the water jacket during operation of the liquid-cooled engine. The water jacket is defined, at least in substantial part, by inner peripheral surfaces of the first cylinder and an outer circumferential surface of a cylinder liner when inserted into the first cylinder.

The details of one or more embodiments are set-forth in the accompanying drawings and the description below. Other features and advantages will become apparent from the description, the drawings, and the claims.

BRIEF DESCRIPTION OF THE DRAWINGS

At least one example of the present disclosure will hereinafter be described in conjunction with the following figures.

Figure 1:
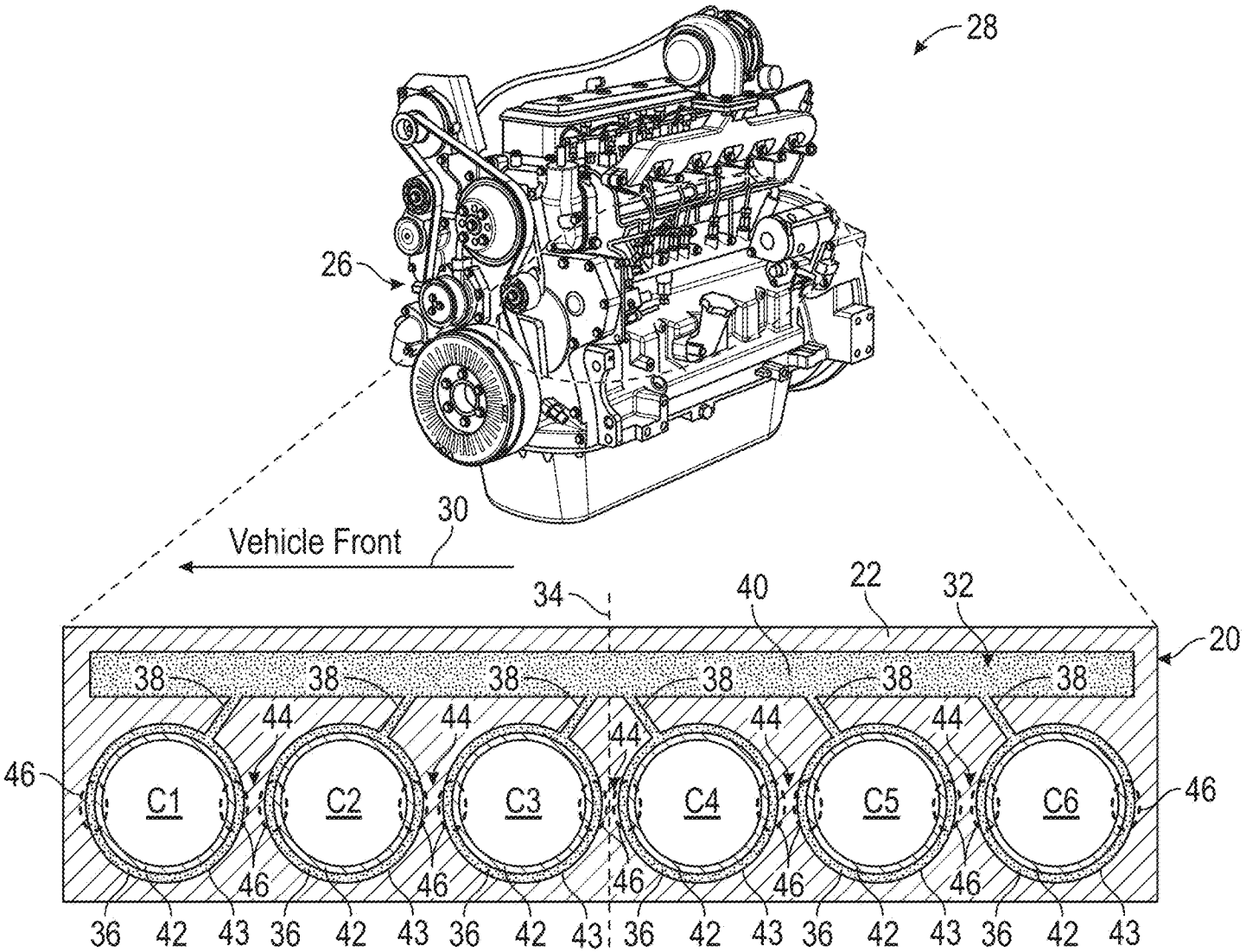
FIG. 1 depicts an example liquid-cooled engine (shown in perspective) including an engine block assembly (shown as a cross-sectional schematic), with dashed circles identifying regions of the engine block in which anti-cavitation channels are usefully formed in certain embodiments of the present disclosure.

Like reference symbols in the various drawings indicate like elements. For simplicity and clarity of illustration, descriptions and details of well-known features and techniques may be omitted to avoid unnecessarily obscuring the example and non-limiting embodiments of the invention described in the subsequent Detailed Description. It should further be understood that features or elements appearing in the accompanying figures are not necessarily drawn to scale unless otherwise stated.

DETAILED DESCRIPTION

Embodiments of the present disclosure are shown in the accompanying figures of the drawings described briefly above. Various modifications to the example embodiments may be contemplated by one of skill in the art without departing from the scope of the present invention, as set-forth the appended claims. As appearing herein, the term "anti-cavitation engine block" refers to an engine block in which one or more anti-cavitation channels are formed, as described below. Similarly, the term "engine block assembly" refers to an anti-cavitation engine block assembled or combined with one or more additional components, such as cylinder liners bounding the outer peripheries of water jackets encasing the engine block cylinders.

Overview

As previously noted, liquid-cooled internal combustion engines commonly contain water jacket-based cooling systems; that is, cooling systems including water jackets encasing the cylinders liners and through which a liquid coolant is circulated to remove excess heat from the cylinder liners, the cylinder headers, and other components during engine operation. In certain instances, cavitation can occur within the water jackets as highly elevated temperatures and low vapor pressures develop within certain localized regions of the water jackets. In the event of cavitation, the highly concentrated forces resulting from the inward collapse of low pressure bubbles can physically dislodge bits of material from the outer surfaces of the liners; and, depending upon the severity of cavitation, potentially cause relatively deep pitting or other structural compromise of the cylinder liners. Water jacket cavitation is a somewhat complex phenomenon due to the various factors influencing the occurrence of cavitation. Such factors may include, but are not limited to, the operating characteristics of the engine (e.g., combustion temperatures), coolant flow characteristics through the water jackets, the degree of cylinder liner displacement (particularly at maximum thrust displacement), and critical engine dimensions, such as cylinder-to-cylinder spacing, liner wall thickness, and local water jacket thicknesses (as measured radially from the cylinder centerlines).

To reduce the likelihood of water jacket cavitation and cylinder liner damage, engine block assemblies including anti-cavitation engine blocks are provided; that is, engine blocks having open, axially-elongated trenches or "anti-cavitation channels" formed in selected or targeted regions thereof. Specifically, the anti-cavitation channels are formed in the inner block walls of the engine block, which peripherally bound the cylinders and the water jackets formed between the inner block walls and the cylinders liners (when inserted into their corresponding cylinders). The anti-cavitation channels are usefully formed adjacent regions of the cylinder liners identified as particularly susceptible to cavitation damage, such as in selected regions of the inter-cylinder wall sections extending between and partitioning adjacent cylinders.

In certain implementations, two or more anti-cavitation channels may be formed in a given side of an inter-cylinder wall section. Depending upon minimum permissible wall thickness and other design considerations, the anti-cavitation channels may be separated by a non-channeled region of the inter-cylinder wall section. In such embodiments, the anti-cavitation channels may be disposed on opposing sides of a connecting line intersecting and extending perpendicular to two or more cylinder centerlines, as taken in a section plane orthogonal to the cylinder centerlines. Anti-cavitation channels may be formed on both sides of an inter-cylinder wall section in such embodiments; or, instead, the anti-cavitation channels may be exclusively formed in a single side of a given inter-cylinder wall section. In alternative embodiments, the anti-cavitation channels may be formed at other locations of the inner block walls adjacent other regions of the water jackets prone to cavitation. In either instance, the anti-cavitation channels may effectively increase or enlarge local water jacket thicknesses adjacent the cavitation-prone regions of the water jacket to reduce, if not prevent cavitation-induced damage to the cylinder liners during operation of a liquid-cooled engine.

The below-described anti-cavitation engine blocks can be fabricated in different manners. In certain implementations, the general, rough form, or "near net" shape of the anti-cavitation engine block is initially cast; and, afterwards, machining is performed to create the anti-cavitation channels in selected regions of the inner block walls. For example, in one approach, the anti-cavitation channels may be produced utilizing a computer-controlled cutting technique, such as plunge cutting. In other embodiments, the anti-cavitation channels may be defined, in whole or in part, when initially casting the engine block. Machining may then be performed to further refine the anti-cavitation channels, as needed. Such manufacturing approaches enable the integration of the anti-cavitation channels into engine block designs with relatively little modification and minimal additional cost. These advantages notwithstanding, other manufacturing techniques for fabricating the anti-cavitation channels and, more generally, the anti-cavitation engine block are also possible in further implementations.

An example embodiment of an engine block assembly including an anti-cavitation engine block will now be described in conjunction with FIGS. 1-7. By way of non-limiting example, the following describes the anti-cavitation engine block in the context of a particularly type of liquid-cooled engine, namely, a diesel engine having an in-line, six cylinder configuration and suitable for usage onboard a tractor or other work vehicle. The following example notwithstanding, the anti-cavitation engine block can be incorporated into various types of liquid-cooled internal combustion engines benefiting from enhanced protection against water jacket cavitation, including engine blocks having flat and V-piston configurations.

Example Embodiment of an Engine Block Assembly Including an Anti-Cavitation Engine Block With initial reference to FIG. 1, an engine block assembly 20 including an anti-cavitation engine block 22 is illustrated in accordance with an example embodiment of the present disclosure. As shown in the upper half of FIG. 1, the engine block assembly 20 may be generally located within a circled region 24 of a liquid-cooled internal combustion engine 26, which is included within a larger vehicle powertrain 28 (partially shown). Here, the liquid-cooled internal combustion engine 26 (hereafter, "the liquid-cooled engine 26") contains six cylinders arranged in an inline (single row or bank) configuration. For ease of reference, the cylinders contained within the liquid-cooled engine 26 are successively numbered as "C1" through "C6." The C1 cylinder is contained within the forwardmost or leading end portion of the anti-cavitation engine block 22; that is, the portion of the engine block 22 located closest the vehicle front, as indicated by arrow 30. The C2 through C6 cylinders are number in succession following the C1 cylinder in an aftward direction, with the C6 cylinder contained within the trailing end portion of the engine block 22.

A water jacket cooling system 32 is integrated into the liquid-cooled engine 26. The water jacket cooling system 32 includes a plurality of water jackets 36, as well as various plumbing features formed in the anti-cavitation engine block 22. The plumbing features may include, for example, a number of coolant flow passages 38 branching from a coolant manifold 40 formed in a side portion of the engine block 22. Although not shown individually for clarity, the water jacket cooling system 32 further includes various other components for providing the desired coolant circulation function, including a pump, a radiator (or other heat exchanger), and additional fluid connections. The water jackets 36 each extend at least partially around, and may fully circumscribe, the C1 through C6 cylinders. In the illustrated example, the water jackets 36, the coolant manifold 40, and the coolant flow passages 38 are generally bilaterally symmetrical about a vertical plane 34 extending between the C3 and C4 cylinders (orthogonal to the plane of the page in the lower portion of FIG. 1). In further implementations, the engine block assembly 20 may assume another form, while the water jacket cooling system 32 may include various other components suitably for circulating a liquid cooling through any practical number of water jackets within the anti-cavitation engine block 22.

Cylinder sleeves or liners 42 are inserted into each of the C1 through C6 cylinders. When viewed in three dimensions, the cylinder liners 42 assume the form of generally annular or tubular bodies, which are sized for a close tolerance fit or mating reception within the C1 through C6 cylinders. The outer diameters of the cylinders liners 42 are dimensioned to provide an annular clearance or gap between midsections of the cylinder liners 42 and the inner block walls 43, which bound the outer peripheries of the C1 through C6 cylinders. This annular clearance or gap between the midsections of the cylinder liners 42 and the inner block walls 43 defines the water jackets 36, at least in substantial part. Specifically, the outer circumferential surfaces of the cylinder liners 42 bound or define the inner perimeters of the water jackets 36, while the inner block walls 43 of the engine block body 45 bound or define the outer perimeters of the water jackets 36. The portions of the inner block walls 43 extending between and partitioning adjacent cylinders are identified by reference numerals "44" in the below-described drawing figures and are referred to hereafter as "inter-cylinder wall sections 44."

As represented by dot stippling in FIG. 1, a liquid coolant (e.g., water admixed with one or more additives) is supplied to each of the water jackets 36 during operation of the liquid-cooled engine 26. The liquid coolant is drawn from the coolant manifold 40 and directed through the coolant flow passages 38, each of which connects the coolant manifold 40 to a different one of the water jackets 36. In certain instances, and as previously noted, cavitation may occur within certain localized regions of the water jackets 36 depending upon local vapor pressures, local temperatures, and other factors occurring during operation of the liquid-cooled engine 26. Absent provision of the anti-cavitation channels described below, such cavitation may be sufficiently severe to impart an undesirable degree of structural damage to the cylinder liners 42 by, for example, inducing pitting or other material loss along the outer circumferential walls of the cylinder liners 42 exposed to the cavitation. Further description of the location and severity of cavitation damage to an example cylinder liner contained in a tested engine block lacking anti-cavitation channels is set-forth below in the section entitled "TESTING RESULTS AND EXAMPLE REDUCTION TO PRACTICE."

As described throughout this document, the anti-cavitation channels are usefully formed adjacent regions of the cylinder liners 42 susceptible to structural damage should cavitation occur within the water jackets 36 during operation of the liquid-cooled engine 26. The locations at which cavitation is prone to occur within the water jackets 36, and therefore the regions of the cylinder liners 42 vulnerable to cavitation-caused damage, will vary among embodiments. So too will the positioning and other physical characteristics (e.g., shape and dimensions) of the anti-cavitation channels vary between different embodiments of the anti-cavitation engine block 22. However, by way of non-limiting example, undesirably high levels of cavitation may be prone to occur in some or all of the areas of the water jackets 36 called-out in FIG. 1 by dashed circles 46. Generally, these circled regions 46 correspond to the portions of the water jackets 36 adjacent the front and rear (forward and aft) quadrants of the cylinder liners 42; with terms "front," "rear," "forward," and "aft" defined relative to the intended orientation of the engine block assembly 20 when installed within a vehicle.

The circled regions 46 of the water jackets 36 may be prone to cavitation due to the relatively close cylinder-to-cylinder spacing in the illustrated example, restrictions in the flow area of the water jackets 36 in these regions (more clearly shown in subsequent drawing figures), liner thrust displacement characteristics, and other such factors. Additionally, other characteristics related to the fabrication of the anti-cavitation engine block 22, such as potential core shift occurring during casting of the engine block 22, may also influence whether cavitation occurs in any or all of the regions 46. Consequentially, in embodiments, it may be beneficial to form anti-cavitation channels at locations of the inter-cylinder wall sections 44 to enlarge the local radial thicknesses of the water jackets 36 adjacent or proximate some, if not all of the circled regions 46 denoted in FIG. 1. Stated more generally, in embodiments, the anti-cavitation channels are usefully formed in targeted regions of the inter-cylinder wall sections 44 interspersed with the C1-C6 cylinders along a longitudinal axis of the engine block 22, as described in detail below. In other implementations, the anti-cavitation channels may be formed in other targeted regions of the inner block walls 43 in addition to or in lieu of the inter-cylinder wall sections 44 separating the cylinders.

Figure 2:
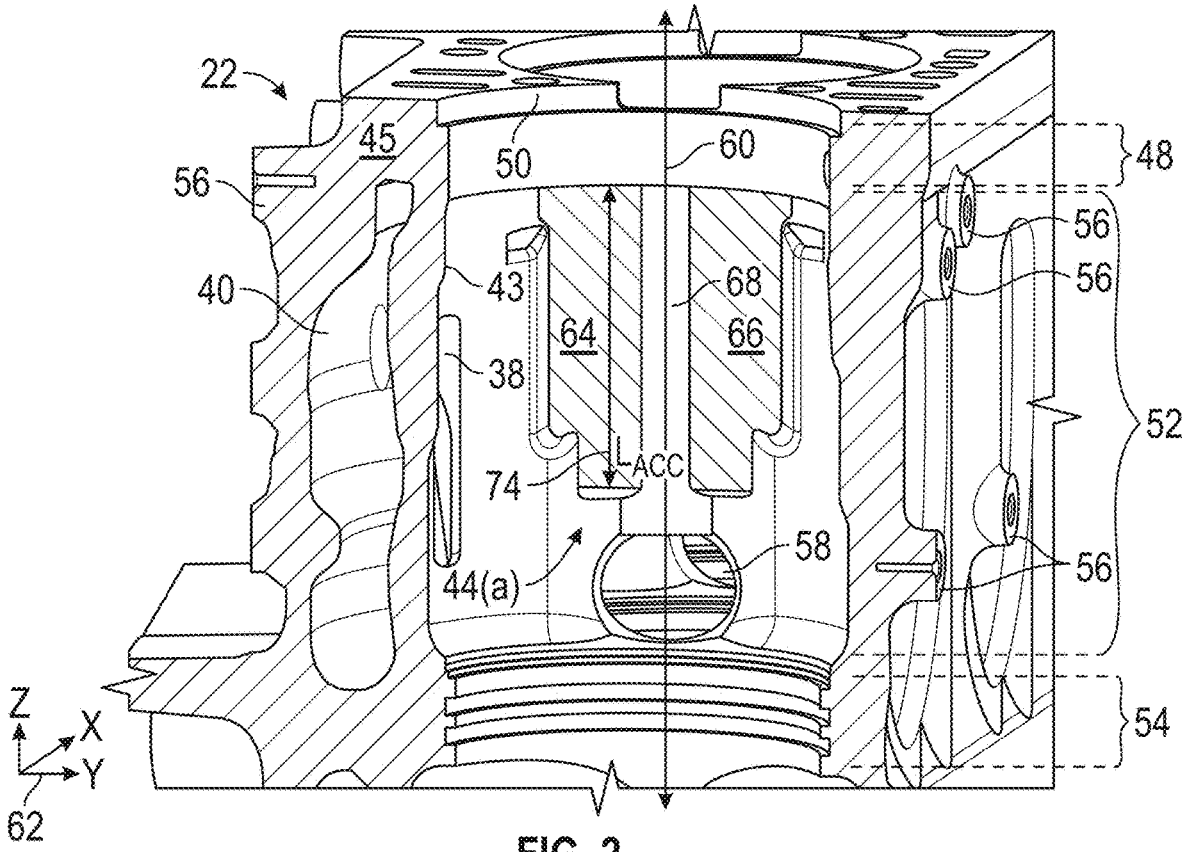
FIG. 2 is a cross-sectional view of an anti-cavitation engine block included in the example engine block assembly of FIG. 1, as taken along a section plane extending through a cylinder and parallel to the cylinder centerline, illustrating two example anti-cavitation channels formed in an inter-cylinder wall section of the engine block.
Figure 3:
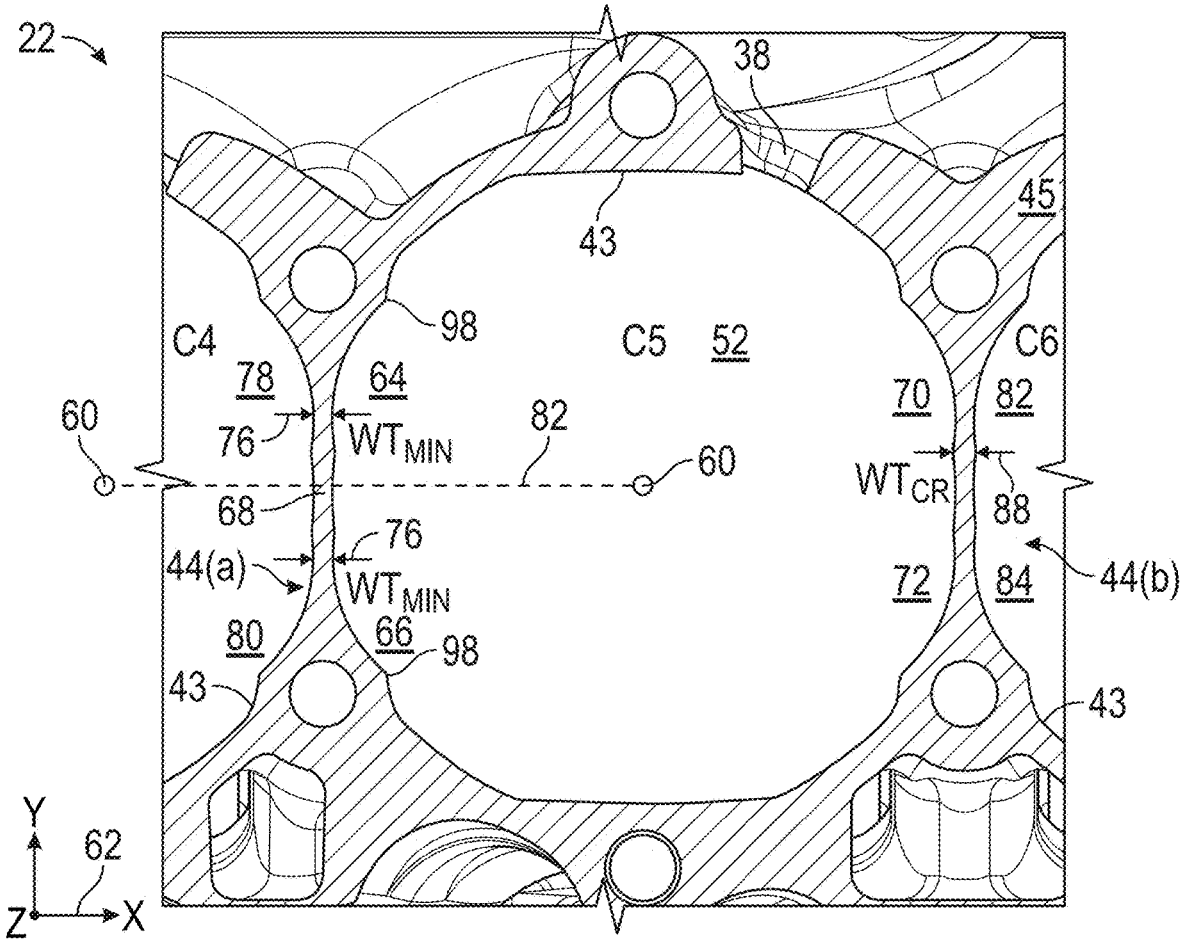
FIG. 3 is a cross-sectional view of the example anti-cavitation engine block, as taken along a section plane orthogonal to a cylinder centerline, further illustrating a number of anti-cavitation channels formed in inter-cylinder wall sections of the engine block and angularly spaced about the cylinder centerline.

Referring to FIGS. 2 and 3 in combination with FIG. 1, the following will now describe a number of anti-cavitation channels formed in an example cylinder of the example anti-cavitation engine block 22. In particular, the following description principally focuses on four anti-cavitation channels 64, 66, 70, 72 formed at different locations angularly spaced about the centerline of the C5 cylinder. As will become apparent from the following discussion, a first pair of the anti-cavitation channels 64, 66 is formed in a first inter-cylinder wall section 44 of the anti-cavitation engine block 22, which separates or partitions the C4 and C5 cylinders (identified by reference numeral "44(*a*)") taken along a longitudinal axis of the engine block 22 perpendicular to the cylinder centerlines 60. Similarly, a second pair of the anti-cavitation channels 70, 72 is formed in a second inter-cylinder wall section 44 of the engine block 22, which separates or partitions the C5 and C6 cylinders (identified by reference numeral "44(*b*)" in FIGS. 2 and 3). While the following description focuses principally on the C5 cylinder and the anti-cavitation channels 64, 66, 70, 72 formed thereabout, similar, if not identical anti-cavitation channeling may be provided about some or all of the other cylinders (the C1-C4 and C6 cylinders) of the anti-cavitation engine block 22. In the context of the illustrated example, then, the following description may be considered equally applicable to all of the cylinders included in the anti-cavitation engine block 22. In alternative embodiments, the anti-cavitation channeling may differ between cylinders; and, in certain instances, only a subset of the cylinders contained in the engine block 22 may be provided with anti-cavitation channels.

The planform shape or geometry of the anti-cavitation channels 64, 66 is best seen in FIG. 2, in which the anti-cavitation channels 64, 66 are cross-hatched for visual clarity. In this example, the anti-cavitation channels 64, 66 extend over half of the length of the combustion section 52 of the C5 cylinder, but do not extend the full length of the combustion section 52. The combustion section 52 corresponds to the region the C5 cylinder in which internal combustion and piston reciprocation principally occurs during operation of the liquid-cooled engine 26. For completeness, it is noted that the illustrated portion of the C5 cylinder also includes an upper section 48 and a lower, grooved section 54. The upper section 48 of the C5 cylinder contains a circumferential ledge or shelf 50, which matingly receives a flange provided around the upper edge of a cylinder liner 42 when inserted into the C5 cylinder (shown in FIG. 4 and described below). Below the combustion section 52, the grooved section 54 cooperates with a lower portion of the cylinder liner 42 (again, when inserted into the C5 cylinder) and sealing elements (e.g., O-rings or gaskets) to create a fluid-tight seal beneath the water jacket 36 formed within the C5 cylinder. Various other features of the anti-cavitation engine block 22 are further shown in FIG. 2 including, for example, a number of bolt bosses 56 projecting from the engine block 22, openings or orifices 58 fluidly connecting adjacent cylinders, and a portion of the coolant manifold 40.

The shape and dimensions of the anti-cavitation channels 64, 66, 70, 72 will vary among embodiments. Here, for ease of explanation, it may be assumed that the anti-cavitation channels 70, 72 have planform geometries essentially identical to the anti-cavitation channels 64, 66. Accordingly, and as identified in FIG. 2 by double-headed arrow 74, each of the anti-cavitation channels 64, 66, 70, 72 may be imparted with a maximum channel length $L_{ACC}$ measured axially along the centerline 60 of the C5 cylinder. Comparatively, the cylinder liner 42 subsequently inserted into the C5 cylinder (shown in FIG. 4) may have an axial length $L_{CL}$, as further measured along the cylinder centerline 60. In the illustrated example, the anti-cavitation channels 64, 66, 70, 72 each extend axially from an upper edge of the combustion section 52 of the cylinder downwardly toward, but terminate before reaching the lower edge of the combustion section 52. The maximum channel length of the anti-cavitation channels 64, 66, 70, 72 is thus greater than half the length of the cylinder liner, but less than the fully cylinder liner length such that the following equation applies: (0.5) $L_{CL}<L_{ACC}<L_{CL}$. In other embodiments, the anti-cavitation channel length or lengths may be greater than or less than the aforementioned range. Further, the respective maximum channel lengths ($L_{ACC}$) will typically be greater than the maximum widths of the anti-cavitation channels 64, 66, 70, 72, as measured about the inner circumference of C5 cylinder.

As depicted in FIG. 3, a connecting line 86 can be drawn between the cylinder centerlines 60 of the C4 and C5 cylinders. The connecting line 86 may be coaxial with a longitudinal axis of the engine block 22, which intersects and extends perpendicular to the cylinder centerlines 60. The first anti-cavitation channel 64 formed in C5-facing side of the inter-cylinder wall section 44(*a*) is located on a first side of the connecting line 86, as taken in a section plane orthogonal to the C4 and C5 centerlines, such as the section plane shown in FIG. 3. Comparatively, the second anti-cavitation channel 66 further formed in the C5-facing side of the inter-cylinder wall section 44(*a*) is located on a second, opposing side of the connecting line 86. Thus, in the illustrated example in which the anti-cavitation channels 64, 66 are substantially identical, the anti-cavitation channels 64, 66 may be described as substantially bilaterally symmetrical about a plane of symmetry extending parallel to the C5 and C6 centerlines and encompassing the connecting line 86; that is, a plane corresponding to an X-Z plane of the coordinate legend 62 appearing in the bottom left corner of FIG. 3.

The anti-cavitation channels formed in the C5-facing side of the inter-cylinder wall section 44(*a*) are separated by an intervening, non-channeled central region 68 of the inter-cylinder wall section 44(*a*); that is, a region or portion of the inter-cylinder wall section 44(*a*) located between the anti-cavitation channels and into which the anti-cavitation channels do not encroach. The wall thickness of the non-channeled central region 68 of the inter-cylinder wall section 44(*a*) is equivalent to the wall thickness of the non-channeled central region of the inter-cylinder wall section 44(*a*), as shown on the right of FIG. 3 and identified as "$WT_{CR}$" by arrows 88. In embodiments, $WT_{CR}$ be equivalent to or slightly greater than the minimum wall thickness of the inter-cylinder wall section 44(*a*) (herein "$WT_{MIN}$"), two instances of which are identified as by arrows 76 appearing on the left of FIG. 3. In this manner, the inter-cylinder wall section 44(*a*) is imparted with a minimum wall thickness located between the outermost edges 98 of the anti-cavitation channels in the illustrated section plane; that is, the edges of the anti-cavitation channels 64, 66 located furthest from the connecting line 86. Additionally, in embodiments, the minimum wall thickness ($WT_{MIN}$) may be greater than a radius of curvature of each of the anti-cavitation channels 64, 66, 70, 72, as further discussed below in connection with FIGS. 6 and 7.

In the instant example in which $WT_{CR}$ is somewhat greater than $WT_{MIN}$, the inter-cylinder wall section 44(*a*) may be further described as having minimum wall thicknesses (taken in the illustrated section plane) substantially at: (i) a first juncture between the non-channeled central region 68 of the inter-cylinder wall section 44(*a*) and the anti-cavitation channel 64 formed in the wall section 44(*a*); and (ii) a second juncture between the central region 68 of the wall section 44(*a*) and the second anti-cavitation channel 66. Additionally, in the instant example, the non-channeled central region 68 of the inter-cylinder wall section 44(*a*) is located between the two points of minimum wall thickness ($WT_{MIN}$) of the inter-cylinder wall section 44(*a*), as taken in the illustrated cross-section. In certain embodiments, the value of $WT_{MIN}$ may be between 3 and 8 millimeters (mm) and, perhaps, between about 4 and about 5 mm. In other embodiments, $WT_{MIN}$ may be greater than or less than the aforementioned ranges.

In the illustrated example, the disposition and channel depth of the anti-cavitation channels 64, 66 (as formed in the side of the inter-cylinder wall section 44(*a*) facing or opening towards the C5 cylinder) permit the formation of additional anti-cavitation channels 78, 80 on the opposing side of the inter-cylinder wall section 44(*a*); that is, the side of the wall section 44(*a*) facing or opening towards the C4 cylinder on the left of FIG. 3. When provided, the anti-cavitation channels 78, 80 may be essentially identical to the anti-cavitation channels 64, 66, with the channels 78, 80 aligning with the channels 64, 66 along axes parallel to the longitudinal axis of the engine block 22. Accordingly, in such embodiments, the anti-cavitation engine block 22 may be described as including at least: (i) a first plurality of anti-cavitation channels (the channels 64, 66) formed in a first side of an inter-cylinder wall section (here, the wall section 44(*a*)) facing a first cylinder (here, the C5 cylinder); and (ii) a second plurality of anti-cavitation channels (here, the channels 78, 80) formed in a second, opposing side of the inter-cylinder wall section facing a second cylinder (here, the C4 cylinder).

The foregoing statements pertaining to the anti-cavitation channels 64, 66 may likewise apply to the anti-cavitation channels 70, 72 formed in the C5-facing side of the inter-cylinder wall section 44(*b*). Further, the anti-cavitation channels 70, 72 formed in the inter-cylinder wall section 44(*b*) may be described as aligning with the anti-cavitation channels 64, 66 formed in the inter-cylinder wall section 44(*a*), as taken along axes parallel to the longitudinal axis of the engine block 22 (corresponding to the X-axis of coordinate legend 62). Moreover, as shown on the right of FIG. 3, two additional anti-cavitation channels 82, 84 may be formed in the C6-facing side of the inter-cylinder wall section 44(*b*). These anti-cavitation channels 82, 84 formed in the C6-facing side of the inter-cylinder wall section 44(*b*) may align with and, perhaps, be bilaterally symmetric with (mirror opposites of) the anti-cavitation channels 70, 72 formed in the C5 facing side of the of the inter-cylinder wall section 44(*b*) in embodiments.

Figure 4:
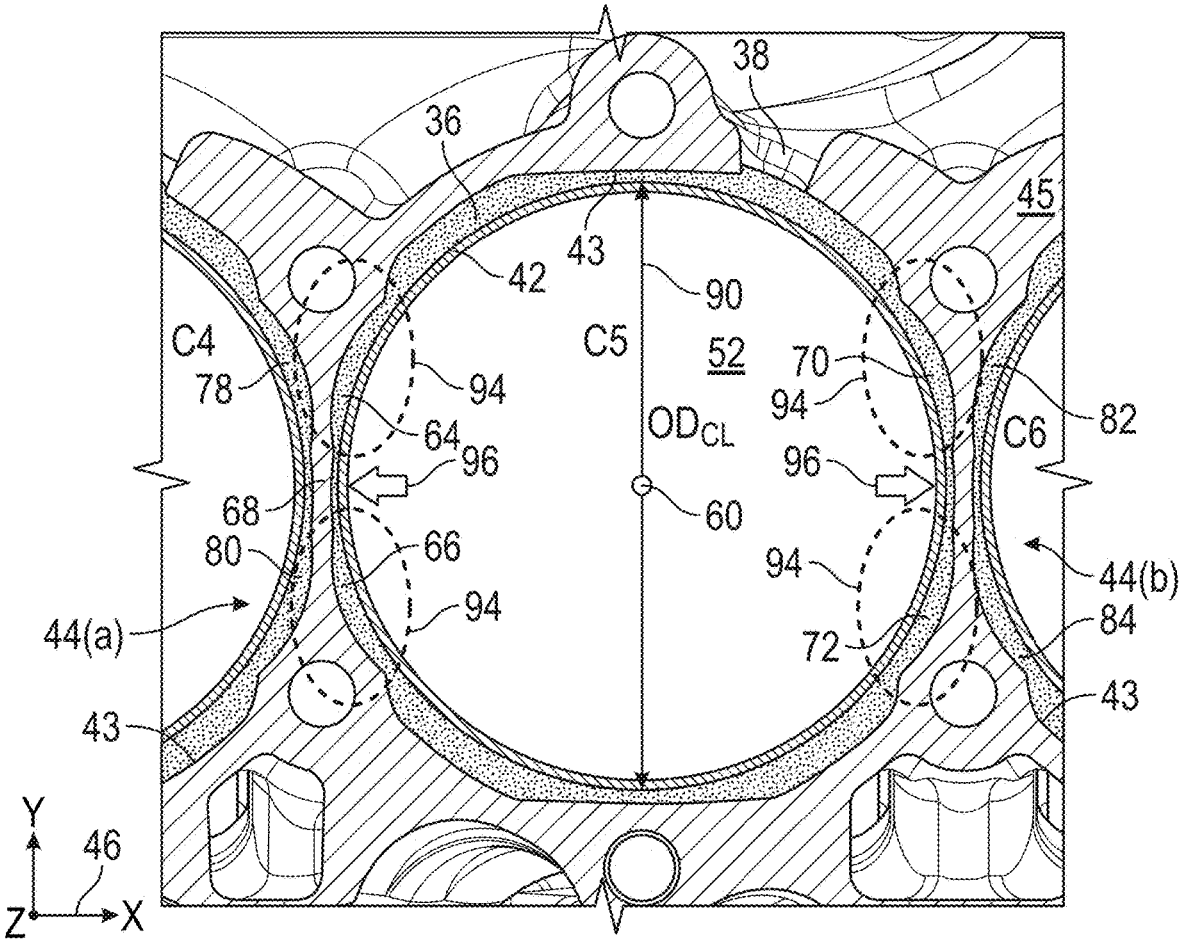
FIG. 4 is a cross-sectional view of the example engine block assembly (corresponding to the cross-section shown in FIG. 3) illustrating one manner in which the anti-cavitation channels may increase local water jacket thickness to deter cavitation within the water jacket during operation of a liquid-cooled engine.

Addressing now FIG. 4 in combination with FIGS. 2 and 3, the anti-cavitation engine block 22 and, more generally, the engine block assembly 20 is shown in cross-section after insertion of a cylinder liner 42 into the C5 cylinder and filling of the now-defined water jackets 36 with a liquid coolant (again, represented by dot stippling). The minimum outer diameter of the cylinder liner 42 inserted into the cylinder C5 is identified as "$OD_{CS}$" by a double-headed arrow 90 in FIG. 4. The outer diameter of the cylinder liner 42 ($OD_{CL}$) is slightly less than the radius of the combustion section 52 of the cylinder C5, which is identified as "$OD_{C_CS}$" by a double-headed arrow 92 in FIG. 5 (further described below). In this manner, and as previously indicated, the illustrated water jacket 36 is defined along its inner periphery by the outer circumferential surface of the cylinder liner 42 and along its outer periphery by the surfaces of the anti-cavitation engine block 22 defining the combustion section 52 of the C5cylinder. Due to the geometric complexity of the engine block 22, certain surfaces of the anti-cavitation engine block 22 may be recessed (taken in a radially-outward direction) relative to the minimum outer diameter of the combustion section 52 ($OD_{C_CS}$). The minimum outer diameter of the combustion section 52 ($OD_{C_CS}$) thus represents a generally cylindrical void or keep-out area into which structural features of the anti-cavitation engine block 22 do not encroach to permit insertion of the cylinder liner 42.

During operation of the liquid-cooled engine 26, the anti-cavitation channels 64, 66, 70, 72 deter cavitation in the targeted regions of the water jacket 36 (FIG. 4) by increasing the local radial thickness of the water jacket 36 in these regions. The areas of increased water jacket thickness are identified in the cross-section of FIG. 4 by four circled regions 94. The provision of anti-cavitation channels 64, 66, 70, 72 is particularly beneficial when it is impractical or generally undesirable to provide a global increase in water jacket thickness (e.g., by increasing $OD_{C_CS}$) as this would result in, for example, excessive thinning of the inter-cylinder wall sections 44 or other regions of the inner block walls 43. Thus, by forming the anti-cavitation channels 64, 66, 70, 72 in the inner block walls 43, local water jacket thickness can be increased adjacent the inter-cylinder wall sections 44 without excessive thinning of the wall sections 44.

With continued reference to FIG. 4, and as indicated by arrows 96, the water jacket 36 includes two regions or areas of maximum flow restriction in the illustrated section plane; that is, regions having a minimum cross-sectional flow area measured in a radial direction. One area of maximum flow restriction is bound along its outer periphery by the non-channeled central region 68 of the inter-cylinder wall section 44(*a*) shown on the left of FIG. 4. This area of flow restriction is consequently located between the anti-cavitation channels 64, 66 formed in the inter-cylinder wall section 44(*a*). Similarly, the other area of maximum flow restriction is partially bound by the non-channeled central region of the inter-cylinder wall section 44(*a*) shown on the right of FIG. 4 and is likewise located between the anti-cavitation channel pair (i.e., the channels 70, 72) formed in the inter-cylinder wall section 44(*b*). The cylinder-to-cylinder spacing and other dimensions of the anti-cavitation engine block 22 may prevent or render impractical enlargement of these regions of maximum flow restriction without violation of the minimum critical wall thickness of the inter-cylinder wall sections 44(*a*), 44(*b*). By providing anti-cavitation channels on either or both sides of such regions of maximum flow restriction, cavitation within and adjacent these regions can be suppressed or eliminated, while maintaining the minimum wall thicknesses ($WT_{MIN}$) of the inter-cylinder wall sections 44(*a*), 44(*b*) equal to or greater than a critical minimal wall thickness. This, in turn, may reduce the likelihood of cavitation by promoting cooling flow, reducing local pressure drops occurring during engine operation, or otherwise affecting local temperature and pressure conditions in a manner deterring cavitation in these regions of the water jacket 36.

There has thus been provided an example embodiment of an anti-cavitation engine block 22 including anti-cavitation channels formed in selected regions of the inner block walls 43, which increase local radial thickness of the water jackets 36 to reduce the likelihood of water jacket cavitation during operation of a liquid-cooled engine. Example methods for manufacturing such an anti-cavitation engine block 22 will now be described in conjunction with FIGS. 5-7.

Examples of Methods for Fabricating the Anti-Cavitation Engine Block

Figure 5:
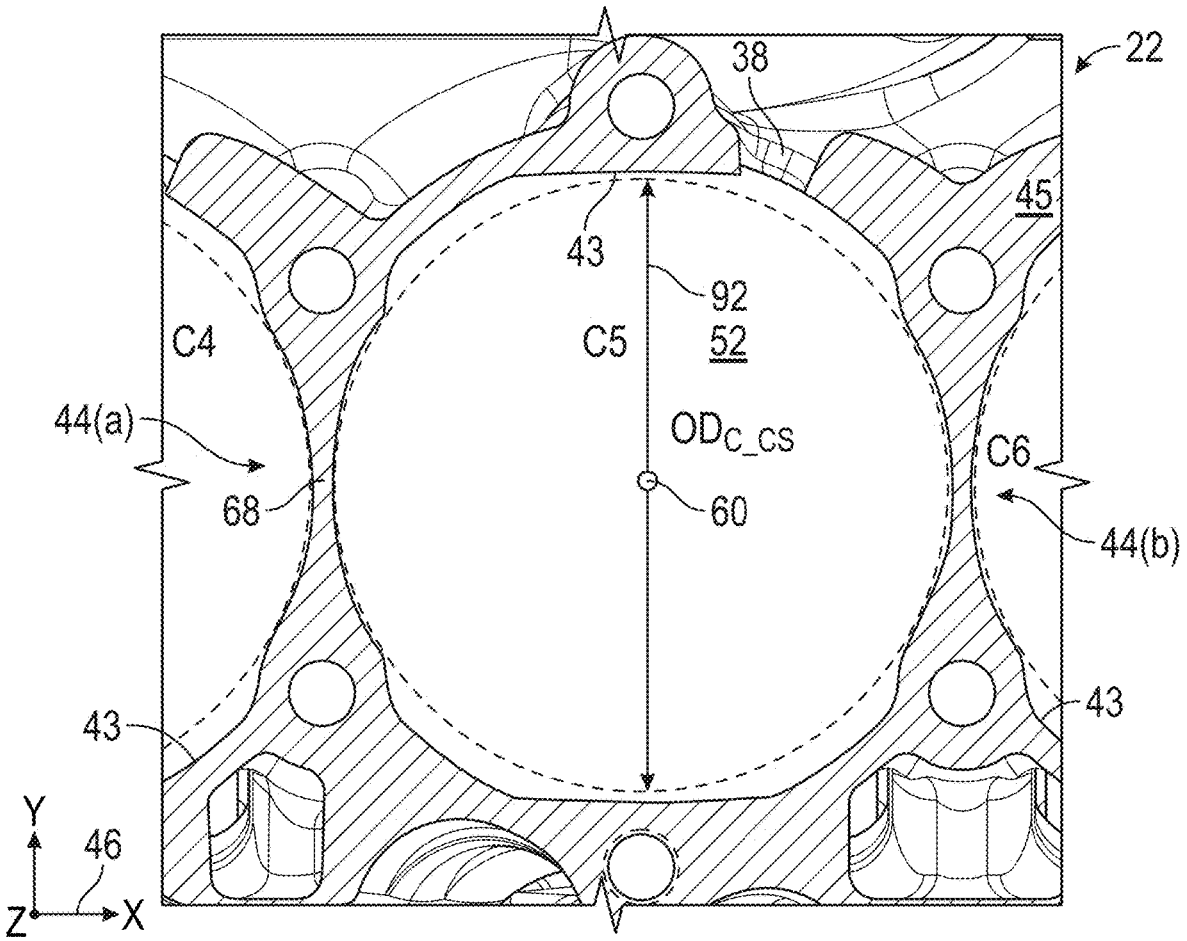
FIG. 5 is a cross-sectional view of the example anti-cavitation engine block of FIGS. 2-4, as shown at an intermediate stage of manufacture following engine block casting and prior to formation of the anti-cavitation channels.

The anti-cavitation engine block 22 shown in FIGS. 1-4 can be fabricated utilizing various different manufacturing approaches, with the anti-cavitation channels partially or wholly created during initial production (e.g., casting) of the engine block preform, by material removal from the engine block preform, or utilizing a combination of these approaches. In embodiments, the anti-cavitation engine block 22 is initially cast as a near net shape lacking the anti-cavitation channels. This is indicated in FIG. 5 in which the engine block casting is identified as "22'," with the prime symbol appended to reference numeral "22" denoting that the anti-cavitation engine block is shown at an intermediate stage of manufacture. Machining is then performed to define the anti-cavitation channels and possibly further create other refined structural features in the anti-cavitation engine block 22', bring certain dimensions into specification, or otherwise modify the structure of the engine block 22 as desired. With respect to the anti-cavitation channels, in particular, four cutting operations may be performed to define the anti-cavitation channels 64, 66, 70, 72 within the illustrated C5 cylinder, with each cutting operation creating a different anti-cavitation channel. Different computer-controlled cutting techniques may be utilized in this regard, with plunge cutting being one suitable example. The anti-cavitation channels located in the other cylinders (the C1-C4 and C6 cylinders) may be formed in a like manner.

Figure 6:
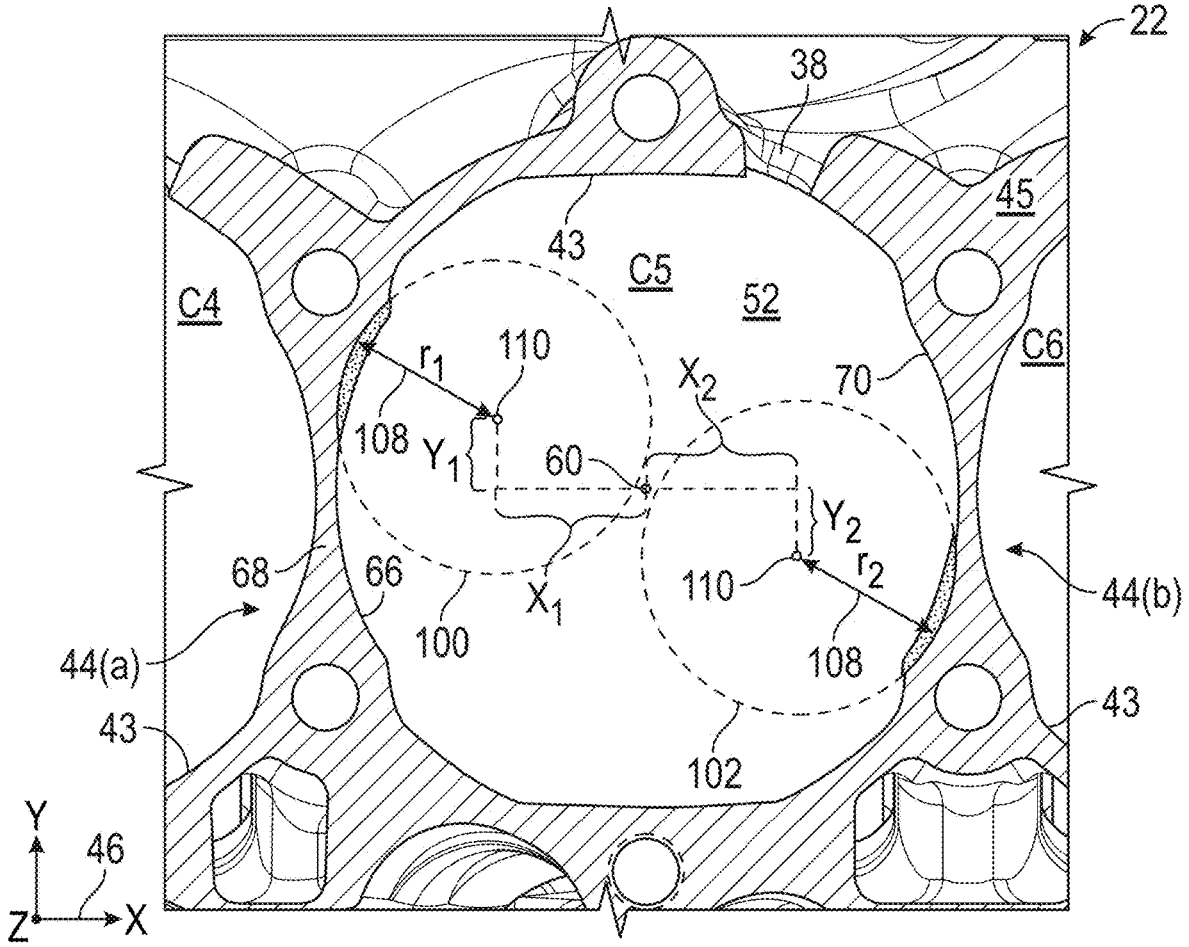
FIGS. 6 and 7 are cross-sectional views depicting post-casting machining steps, which may be performed to cut the anti-cavitation channels into selected regions of the inter-cylinder wall sections in embodiments of the present disclosure.
Figure 7:
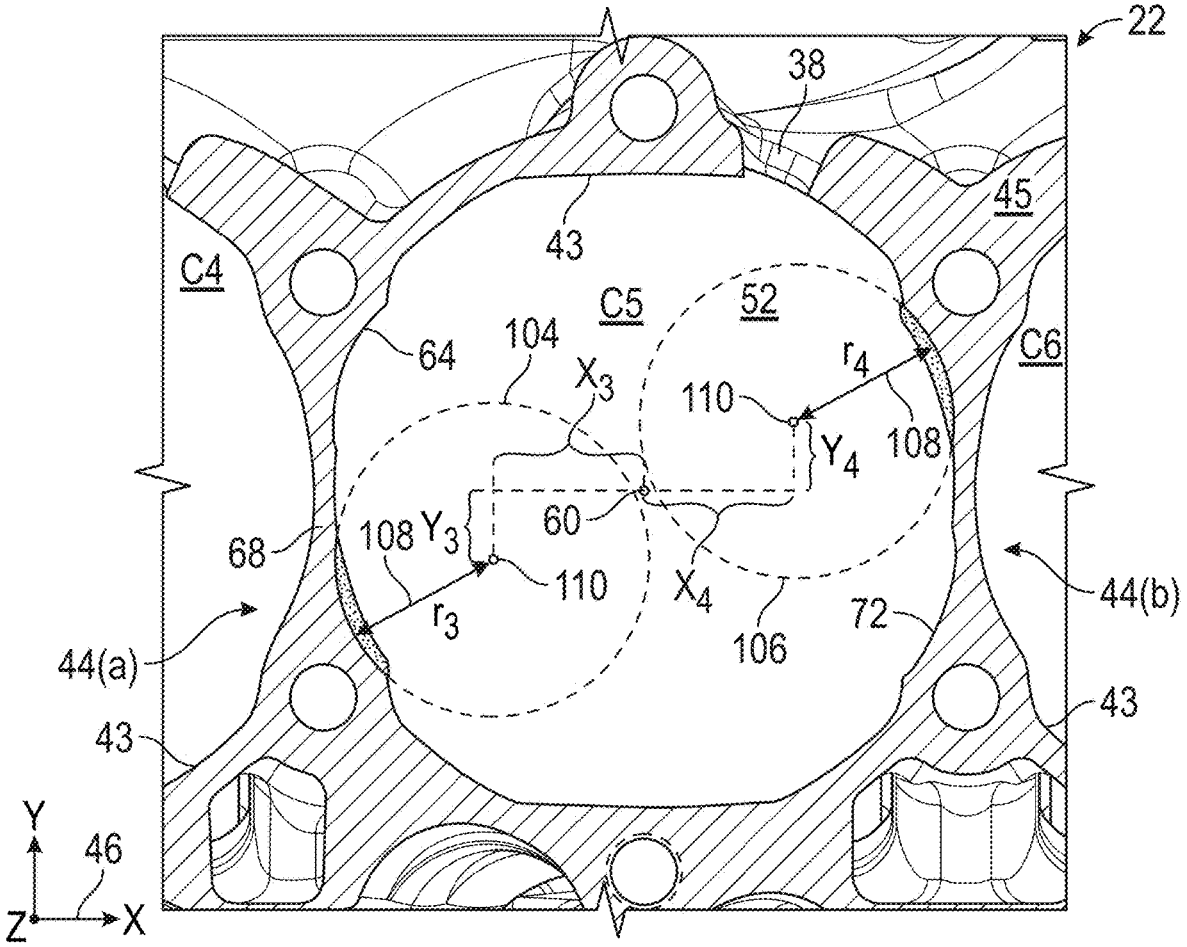

The cutting operations utilized to define the anti-cavitation channels are generically represented in FIG. 6 by two circle graphics 100, 102, while the cutting operations utilized to define the anti-cavitation channels 64, 66, 70, 72 are generically represented in FIG. 7 by circle graphics 104, 106. The material removed from the inter-cylinder wall sections 44(*a*), 44(*b*) by each cutting operation is encompassed by the circle graphics and further denoted by a unique cross-hatching pattern. The cutting operations are represented by two different drawing figures for visual clarity, noting that the cutting operations can be performed in any desired order.

In the instant example, the cross-sectional geometries of the anti-cavitation channels 64, 66, 70, 72 are defined by radii of curvature ($r_1$-$r_4$), as identified in FIGS. 6 and 7 by double-headed arrows 108. The radii of curvature are each measured from the final position of a cutting tool rotational axis, which is represented in FIGS. 6-7 by markers 110 and which is offset from a common reference point in longitudinal (X-axis) and lateral (Y-axis) directions. The reference point in this example is the cylinder centerline 60 of the C5 cylinder. During each iteration of the cutting operation, the cutting tool may be moved to an origin position in which its rotational axis aligns with the cylinder centerline 60. The cutting tool may then be moved to a final position in which the cutting tool's rotational axis is co-axial with one of the markers 110. Accordingly, to create the anti-cavitation channel 64 in the C5-facing side of the inter-cylinder wall section 44(*a*) as indicated in the upper left region of FIG. 6, the cutting tool may be moved longitudinally by a displacement of $X_1$ and laterally by a displacement of $Y_1$, as measured from the cylinder centerline 60. A similar process may then be followed to create the other anti-cavitation channels 66, 70, 72; with the longitudinal displacements for the cutting operations defining the anti-cavitation channels 66, 70, 72 denoted as $X_2$, $X_3$, and $X_4$, respectively, in FIGS. 6-7; and lateral displacements for the cutting operations defining the channels 66, 70, 72 denoted as $Y_2$, $Y_3$, and $Y_4$, respectively.

In the illustrated example in which the anti-cavitation channels 64, 66, 70, 72 are substantially identical, the above-described longitudinal displacements may be equivalent such that $X_1=X_2=X_3=X_4$. Similarly, the above-described lateral displacements are likewise equivalent such that $Y_1=Y_2=Y_3=Y_4$. So too are the radii of curvature ($r_1$-$r_4$) of the anti-cavitation channels 64, 66, 70, 72 equivalent in the illustrated embodiment. As indicated in FIGS. 6 and 7, the radius of curvature for each anti-cavitation channel 64, 66, 70, 72 may be less than the radius of C5 cylinder or, more specifically, the radius of the combustion section 52 ($OD_{C_CS}$ identified in FIG. 5). Concurrently, each anti-cavitation channel 64, 66, 70, 72 is cut into one of the inter-cylinder wall sections 44(*a*), 44(*b*) to a radial depth exceeding the cylinder radius ($OD_{C_CS}$), as measured from the cylinder centerline 60. During the cutting operation, the cutting tool is also swept in an axial direction (along the centerline 60 of the C5 cylinder parallel to the Z-axis of the coordinate legend 62) as appropriate to impart the anti-cavitation channels 64, 66, 70, 72 with their desired lengths, as previously discussed in conjunction with FIG. 2. Again, the anti-cavitation channels may or may not extend the full length of the combustion section 52 of the illustrated C5 cylinder. The foregoing statements may also apply equally to the anti-cavitation channels formed in the other cylinders (C1-C4 and C6) of the anti-cavitation engine block 22.

As noted above, the axial length(s) of the anti-cavitation channels 64, 66, 70, 72 will vary among embodiments. Generally, the anti-cavitation channels 64, 66, 70, 72 are usefully imparted with lengths spanning at least those regions of the cylinder liner 42 in which cavitation damage is prone to occur. Further, in certain, the anti-cavitation channels 64, 66, 70, 72 may begin at the top edges of the C5 cylinder for ease of manufacture when, for example, a plunge cutting technique is utilized to form the anti-cavitation channels 64, 66, 70, 72 (and the other anti-cavitation channels included in the engine block 22). In many instances, cavitation damage is observed over a maximum thrust displacement region of the cylinder liner 42, as measured axially along the cylinder centerline 60 of the cylinder under consideration. Accordingly, in such instances, the anti-cavitation channels 64, 66, 70, 72 may be formed to have maximum axial lengths and locations spanning at least the maximum thrust displacement region of the cylinder liner 42. As a more specific example, the anti-cavitation channels 64, 66, 70, 72 may span (and possibly extend beyond) a range of approximately 75 mm to 115 mm measured from the top edge of the cylinder liner 42 moving downwardly along the cylinder centerline 60 of the C5 cylinder.

In the above-described manner, the anti-cavitation channels 64, 66, 70, 72 are cut into or otherwise formed in selected regions of the inner block walls 43 defining the C5 cylinder and, specifically, into selected regions of the inter-cylinder wall sections 44(*a*), 44(*b*). Additional anti-cavitation channels (including the anti-cavitation channels 78, 80, 82, 84 shown in FIGS. 3-7) are likewise formed in some or all of the other cylinders (the C1-C4 and C6 cylinders) of the anti-cavitation engine block 22 in the illustrated example. The likelihood of cavitation is reduced or eliminated in the targeted regions of the water jackets 36 as a result to better preserve the structural integrity of the cylinder liners 42 over a prolonged operational lifespan. Further, the anti-cavitation channels may be amenable to integration into existing engine block designs with minor modifications and minimal increases in overall manufacturing cost.

Figure 8:
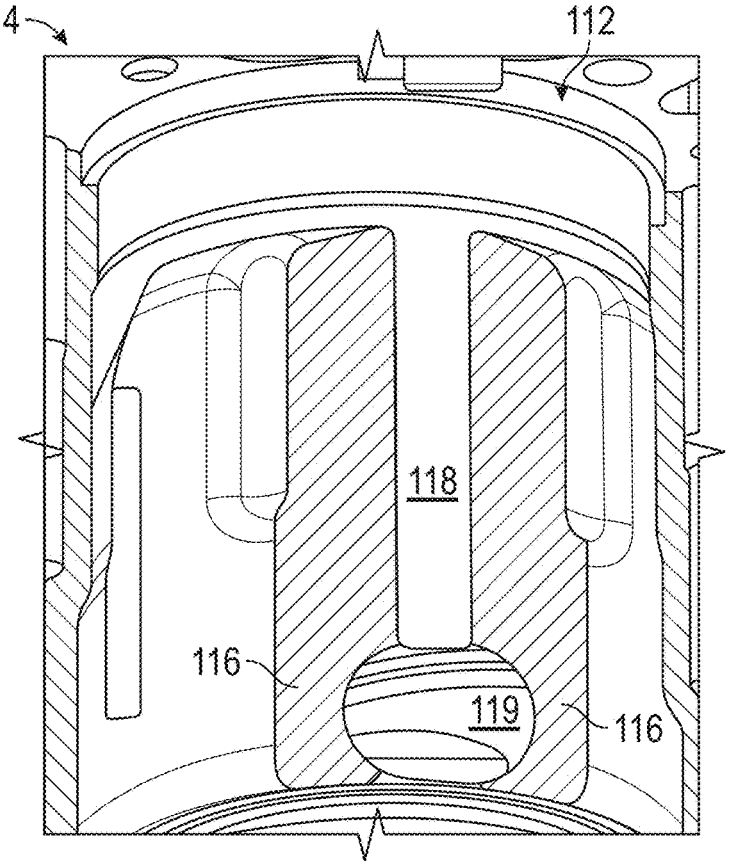
FIG. 8 illustrates an alternative example embodiment in which anti-cavitation channels are formed in an inter-cylinder wall section and substantially extend the entire length of the combustion section of the cylinder.

Additional Example Embodiments of Engine Blocks Including Anti-Cavitation Channels In further embodiments of the anti-cavitation engine block, the shape, dimensions, and disposition of the anti-cavitation channels may vary. For example, in certain embodiments, the anti-cavitation channels may extend the full length of the cylinder; or, at least, the combustion section of the cylinder in which combustion and piston travel occurs. Such a possibility is shown in FIG. 8 for a cylinder 112 formed in an anti-cavitation engine block 114, which is illustrated in accordance with a further example embodiment of the present disclosure. Here, at least two anti-cavitation channels 116 are cut into or otherwise formed in an inter-cylinder wall section 118 partitioning adjacent cylinders. As can be seen, the anti-cavitation channels 116 (cross-hatched for visual clarity) extend the full length of the combustion section of the illustrated cylinder 112, with the lower portion of the anti-cavitation channels 116 extending adjacent and around an opening or orifice 119 fluidly coupling neighboring cylinders.

Figure 9:
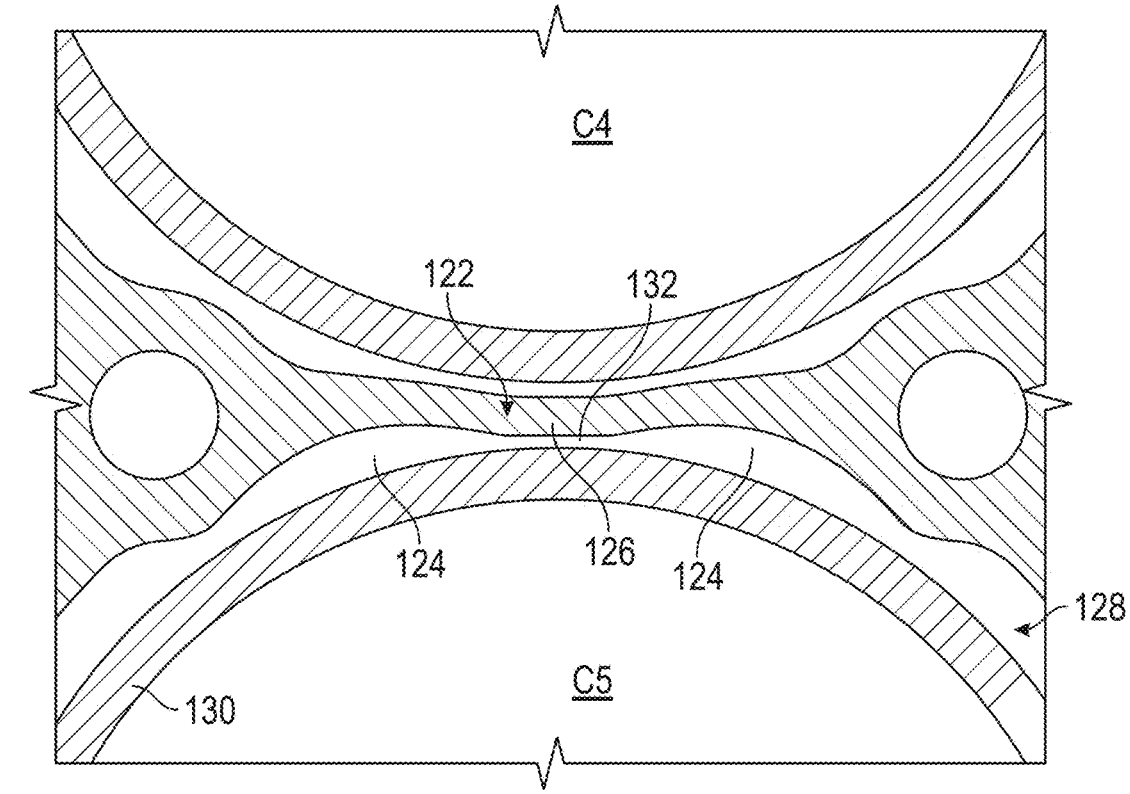
FIG. 9 illustrates a further alternative example embodiment in which anti-cavitation channels are formed exclusively in a single side of an inter-cylinder wall section to, for example, permit an increase in anti-cavitation channel depth without excessive thinning of the inter-cylinder wall section.

In still other embodiments, the anti-cavitation channels may be formed in a single surface or side of a particular inter-cylinder wall section. Such an approach may be useful to, for example, enable an increase in the depth of the anti-cavitation channels, while preventing the minimum wall thickness of the inter-cylinder wall section from decreasing below a lower critical threshold. A representative example is shown in FIG. 9 for a limited region of an anti-cavitation engine block 120 having an inter-cylinder wall section 122 in which two anti-cavitation channels 124 are formed. Here, the inter-cylinder wall section 122 is located between the C4 cylinder and the C5 cylinder, as taken along a longitudinal axis of the engine block 120. The anti-cavitation channels 124 are formed in a single side of the inter-cylinder wall section 122 (i.e., the side of the wall section 122 opening toward the C5 cylinder) to permit an increase in channel depth, while maintaining the minimum wall thickness (located at the junctures between the anti-cavitation channels 124 and the non-channeled central region 126 of the wall section 122) above a predetermined threshold. The anti-cavitation channels 124 thus increase the local radial thicknesses of a water jacket 128 formed around a cylinder liner 130 when inserted into the anti-cavitation engine block 120, as shown in the lower portion of FIG. 9. Further, the water jacket 128 may have an area of maximum flow restriction 132 between the anti-cavitation channels 124, with the anti-cavitation channels 124 decreasing the likelihood of cavitation (and therefore damage to the cylinder liner 130) in the flow restricted region 132 and the other regions of the water jacket 128 adjacent the anti-cavitation channels 124.

Testing Results and Example Reduction to Practice

Steps were taken to first qualify cavitation damage of a cylinder liner tested within a baseline engine block lacking anti-cavitation channeling. Testing was performed over a duration of 375 operation hours, after which the cylinder liner was examined. A Likert scale was developed for this purpose, with the Likert scale ranging from a minimum rating of 1 (little to no cavitation damage observed) to a maximum rating of 6 (severe pitting or damage observed). The testing results are presented schematically on the left column of FIG. 10 for the cylinder liner. Significant cavitation damage (Likert ratings of 3 to 5) was observed on the front section or quadrant of the cylinder liner tested in the baseline engine block. In accordance with the established Likert scale, a Likert rating of 5 is characterized by relatively severe, deep pitting within the cylinder sidewalls, such that the bottom of at least some pit cavities required the usage of a flashlight or other light source to be seen by the unaided eye. Comparatively, a Likert rating of 3 is utilized when pitting is initially beginning to form along the cylinder liner wall. Likert ratings above 2 are considered insufficient or undesirable following the 375 hour screening test.

Figure 10:
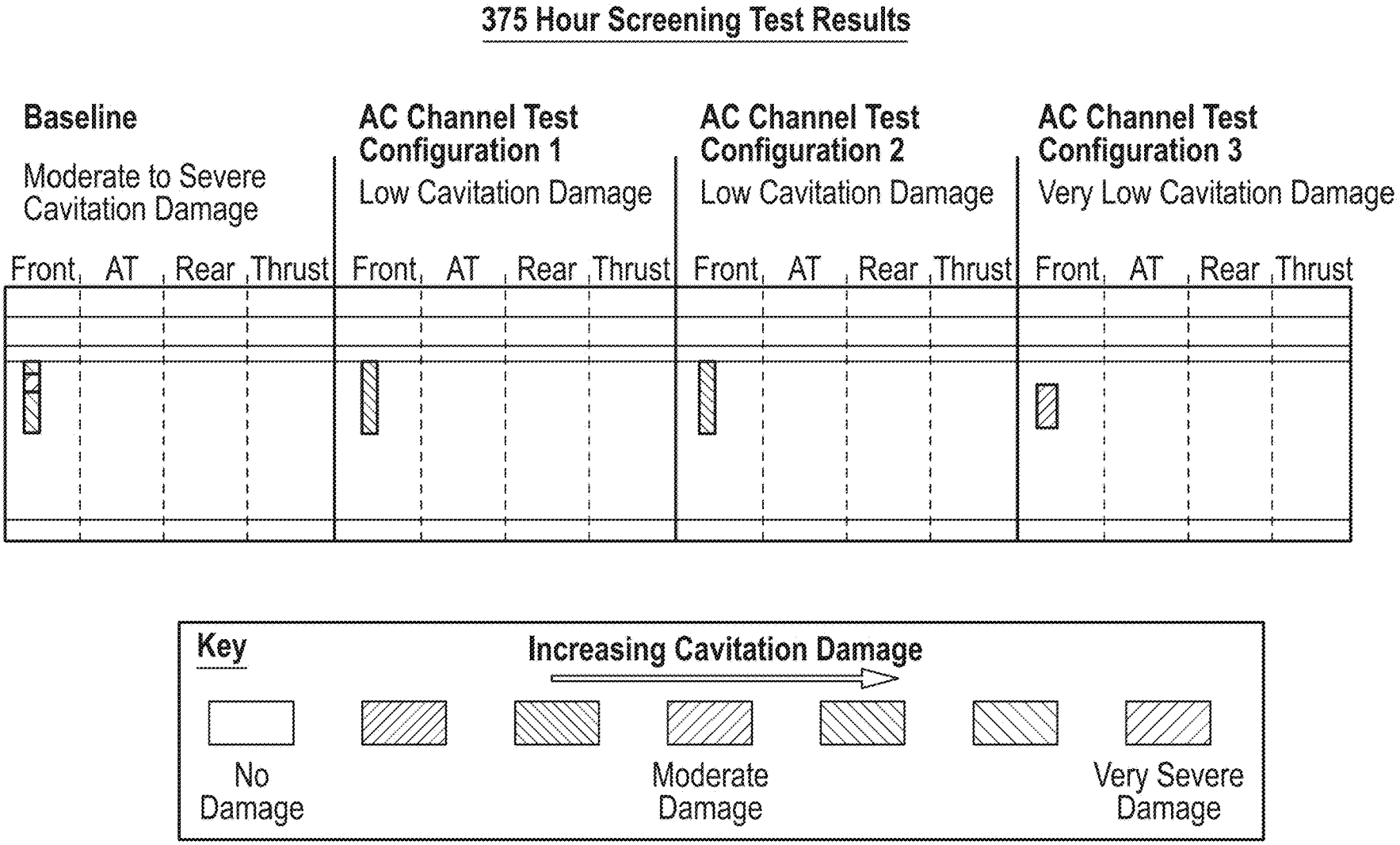
FIG. 10 graphically indicates the location and severity of cavitation damage observed for a cylinder liner tested in an engine block lacking anti-cavitation channels relative to cylinder liners tested in engine blocks having anti-cavitation channels of varying configurations.
Figure 11:
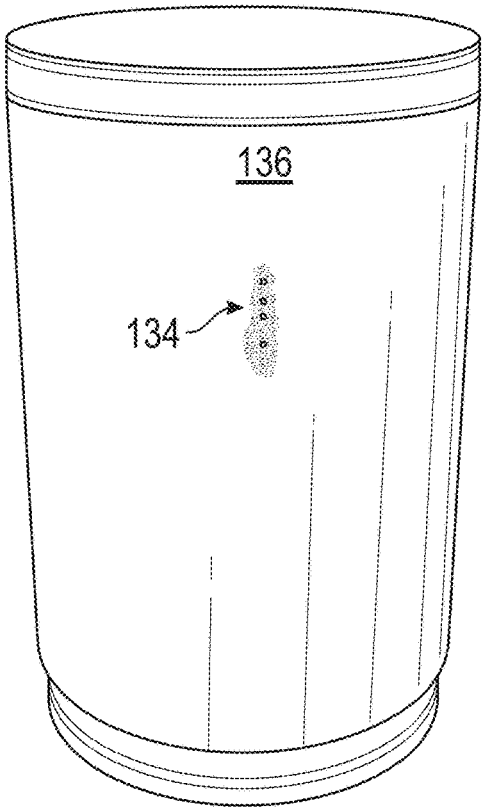
FIG. 11 is a photograph of a tested cylinder liner exhibiting cavitation damage corresponding to that presented in FIG. 10 for the engine block lacking anti-cavitation channels.
Figure 12:
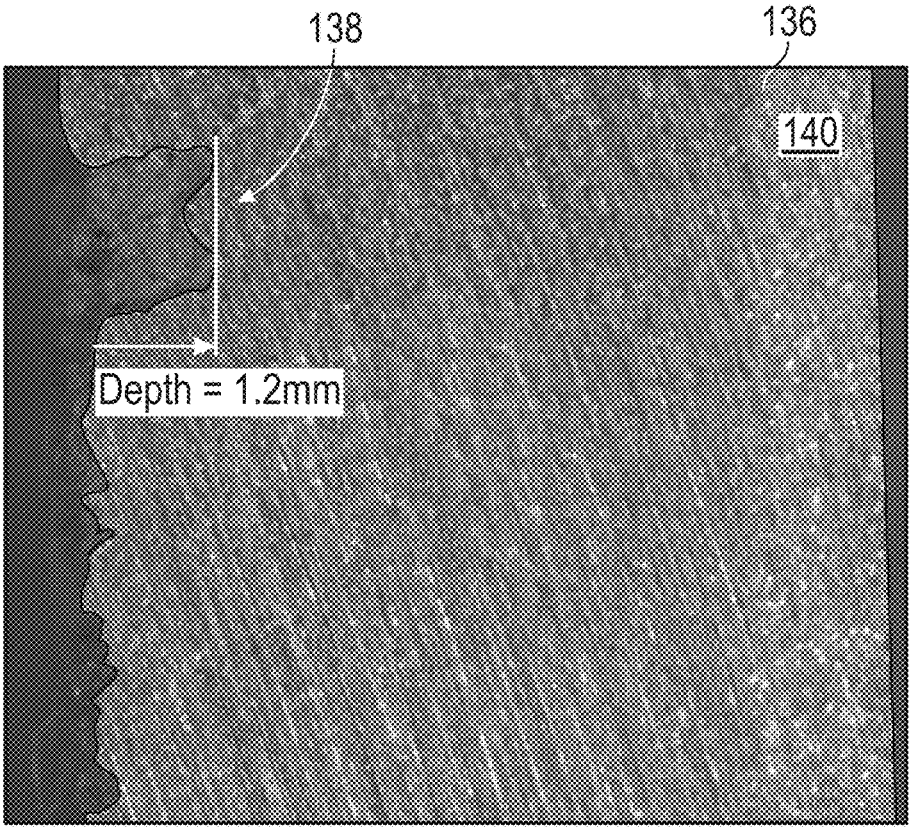
FIG. 12 is a magnified image of a cavitation-damaged region of the cylinder liner shown in FIG. 11 and depicting the depth of cylinder wall pitting due to cavitation within the engine block lacking anti-cavitation channels.

The cavitation-induced damage is further observed in a surface region 134 of the example test cylinder 136, a photograph of which is provided as FIG. 10. A magnified cross-section of the damaged region of the test cylinder 136 is further shown in FIG. 11, with graphics 138 noting that the maximum depth of material loss or pitting of the cylinder wall 140 was measured at approximately 1.2 mm following testing. Little to no cavitation damage was observed in the other quadrants (the anti-thrust (AT), rear or aft, and thrust quadrants) of the cylinder liner tested in the engine block lacking anti-cavitation channeling.

Next, targeted channeling was introduced into the engine block to increase radial water jacket thickness adjacent the regions of the cylinder liner in which severe cavitation damage was recorded. The anti-cavitation channeling was created utilizing a plunge cut technique to remove material from selected regions of the cylinder or inner block walls, as previously described above in connection with FIGS. 6 and 7. Three different anti-cavitation channel (ACC) configurations were tested, varying by cut radii and length (axial depth), as set-forth in TABLE 1 appearing below:

| | Cut Radius | Cut Length (Axial Depth) | Channels formed on both sides of the cylinder inter-cylinder wall section? |
|---|---|---|---|
| ACC Con. 1 | 31.75 mm | Full Cylinder | No |
| ACC Con. 2 | 31.75 mm | 15 mm below bolt boss | No |
| ACC Con. 3 | 38.01 mm | 15 mm below bolt boss | Yes |

Channel configurations 1-3 were subject to a 375 hour screening test, as simulated utilizing computational fluid dynamics (CFD) modeling. All three anti-cavitation channel configurations demonstrated significantly enhanced protection of the tested cylinder liners from cavitation-induced damage due to a decrease in the severity of cavitation occurring within the surrounding water jackets. This is further graphically shown in the second, third, and fourth columns of FIG. 10. As can be seen, the first and second anti-cavitation channels configurations (ACC Con. 1 and Con. 2) effectively reduced cavitation-caused damage to the tested cylinder liner to a Likert scale of 2 or less. For purpose of testing, a Likert rating of 2 denotes frosting visible to the unaided eye, but pitting has not formed. This is considered an acceptable Likert rating following the 375 hour screening test. The third anti-cavitation channel configuration (ACC Con. 3) reduced the observed liner cavitation damage to a Likert scale 1, while further reducing the axial span of the observed damage. A Likert rating of 1 indicates exceptionally light cylinder liner wear caused by cavitation; e.g., as indicated by a light frosting, which requires the application of an additional light source (e.g., a flashlight beam) to readily observe.

Enumerated Examples of the Engine Block Assemblies Containing Anti-Cavitation Engine Blocks The following examples of the engine block assemblies including anti-cavitation engine blocks are further provided and numbered for ease of reference.

1. In embodiments, an engine block assembly contains an anti-cavitation engine block. The anti-cavitation engine block includes, in turn, a first cylinder having a first cylinder centerline, a second cylinder having a second cylinder centerline, and a first inter-cylinder wall section. The first inter-cylinder wall section is located between the first cylinder and the second cylinder, as taken along a longitudinal axis perpendicular to the first and second cylinder centerlines. A first plurality of anti-cavitation channels is formed in the first inter-cylinder wall section, while a cylinder liner is inserted into the first cylinder. The cylinder liner has an outer circumferential surface toward which the first plurality of anti-cavitation channels open. A water jacket extends at least partially around the outer circumferential surface of the cylinder liner. The first plurality of anti-cavitation channels increase local radial thicknesses of the water jacket to deter cavitation within the water jacket and adjacent the cylinder liner during operation of the liquid-cooled engine.

2. The engine block assembly of example 1, wherein the first plurality of anti-cavitation channels includes: (i) a first anti-cavitation channel formed in the first inter-cylinder wall section; and (ii) a second anti-cavitation channel formed in the first inter-cylinder wall section and spaced from the first anti-cavitation channel by a non-channeled central region of the first inter-cylinder wall section.

3. The engine block assembly of example 2, wherein the first anti-cavitation channel and the second anti-cavitation channel are located on opposing sides of a connecting line extending from the first cylinder centerline to the second cylinder centerline, as taken in a section plane orthogonal to the first cylinder centerline.

4. The engine block assembly of example 3, wherein the first anti-cavitation channel is substantially bilaterally symmetrical with the second anti-cavitation channel about a plane of symmetry containing the connecting line and the first cylinder centerline.

5. The engine block assembly of example 2, wherein the water jacket has an area of maximum flow restriction in the axial section plane. The area of maximum flow restriction is located between the first anti-cavitation channel and the second anti-cavitation channel.

6. The engine block assembly of example 2, wherein the first inter-cylinder wall section has minimum wall thicknesses, taken in the axial section plane, located substantially: (i) at a first juncture between the non-channeled central region and the first anti-cavitation channel; and (ii) a second juncture between the non-channeled central region and the second anti-cavitation channel.

7. The engine block assembly of example 1, wherein the first cylinder has a cylinder radius taken in a section plane orthogonal to the first cylinder centerline. Further, the first plurality of anti-cavitation channels each have a radius of curvature less than the cylinder radius, as taken in the section plane.

8. The engine block assembly of example 7, wherein the first inter-cylinder wall section has a minimum wall thickness, as taken in the section plane, less than the radius of curvature.

9. The engine block assembly of example 1, further including: a third cylinder; a second inter-cylinder wall section located between the first cylinder and the third cylinder, as taken along the longitudinal axis; and a second plurality of anti-cavitation channels formed in the second inter-cylinder wall section.

10. The engine block assembly of example 9, wherein the first plurality of anti-cavitation channels includes first and second anti-cavitation channels. Similarly, the second plurality of anti-cavitation channels include third and fourth anti-cavitation channels. The third and fourth anti-cavitation channels substantially align with the first and second anti-cavitation channels, respectively, along axes parallel to the longitudinal axis.

11. The engine block assembly of example 1, wherein the inter-cylinder wall section has a first side facing the first cylinder and has a second, opposing side facing the second cylinder. The first plurality of anti-cavitation channels is formed in the first side of the first inter-cylinder wall section. Additionally, the anti-cavitation engine block further includes a second plurality of anti-cavitation channels formed in the second, opposing side of the first inter-cylinder wall section.

12. The engine block assembly of example 1, wherein the first plurality of anti-cavitation channels each have a maximum channel width, as taken in a section plane orthogonal to the first cylinder centerline. The first plurality of anti-cavitation channels each have a channel length exceeding the maximum channel width, as measured along an axis parallel to the first cylinder centerline.

13. The engine block assembly of example 1, wherein the first plurality of anti-cavitation channels each span a maximum thrust displacement region of the cylinder liner, as taken axially along the first centerline.

14. The engine block assembly of example 1, wherein the anti-cavitation engine block includes a cast engine block body, while the plurality of anti-cavitation channels assume the form of axially-elongated trenches cut into the cast engine block body.

15. In further embodiments, the engine block assembly includes an anti-cavitation engine block utilized within a liquid-cooled engine. A plurality of cylinders is formed in the anti-cavitation engine block and spaced along a longitudinal axis, which is perpendicular to centerlines of the cylinders. The anti-cavitation engine block further include inner block walls, which bound outer peripheries of the anti-cavitation engine block. Cylinder liners are inserted into the plurality of cylinders and have targeted surface regions, which are prone to cavitation damage during operation of the liquid-cooled engine. Anti-cavitation channels are cut into the inner block walls at locations adjacent the targeted surface regions.

CONCLUSION

The foregoing has thus provided anti-cavitation engine blocks (and engine block assemblies including anti-cavitation engine blocks) featuring anti-cavitation channels decreasing the likelihood of water jacket cavitation. The anti-cavitation channels are cut into or otherwise formed in selected regions of the inner block walls defining the engine cylinders; e.g., in embodiments, the anti-cavitation channels may be formed in those regions of the inner block walls located adjacent surface areas of the cylinder liners identified as suspectable to cavitation damage. In certain embodiments, the anti-cavitation channels may be formed in the inter-cylinder wall sections of the inner block walls partitioning adjacent cylinders. Further, in at least some instances, at least two anti-cavitation channels may be formed in a particular side or face of an inter-cylinder wall section, while being separated by non-channeled central region of the wall section. Such an anti-cavitation channel configuration may preserve minimum wall thicknesses, while still providing an appreciable deterrent against cavitation. By reducing the likelihood of cavitation in key regions of the water jackets, embodiments of the above-described anti-cavitation engine blocks better preserve the structural integrity of cylinder liners over extended operational lifespans.

As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. An engine block assembly utilized within a liquid-cooled engine, the engine block assembly comprising:

an anti-cavitation engine block having an engine block body comprising:

a first cylinder having a first cylinder centerline;

a second cylinder having a second cylinder centerline;

a first inter-cylinder wall section located between the first cylinder and the second cylinder, as taken along a longitudinal axis perpendicular to the first cylinder centerline and to the second cylinder centerline; and a first plurality of anti-cavitation channels formed as axially-elongated trenches cut into the case engine block body at the first inter-cylinder wall section;

a cylinder liner inserted into the first cylinder and having an outer circumferential surface toward which the first plurality of anti-cavitation channels opens; and a water jacket extending at least partially around the outer circumferential surface of the cylinder liner, the first plurality of anti-cavitation channels increasing local radial thicknesses of the water jacket to deter cavitation within the water jacket and adjacent the cylinder liner during operation of the liquid-cooled engine.

2. The engine block assembly of claim 1, wherein the first plurality of anti-cavitation channels comprises:

a first anti-cavitation channel formed in the first inter-cylinder wall section; and a second anti-cavitation channel formed in the first inter-cylinder wall section and spaced from the first anti-cavitation channel by a non-channeled central region of the first inter-cylinder wall section.

3. The engine block assembly of claim 2, wherein the first anti-cavitation channel and the second anti-cavitation channel are located on opposing sides of a connecting line extending from the first cylinder centerline to the second cylinder centerline, as taken in a section plane orthogonal to the first cylinder centerline.

4. The engine block assembly of claim 3, wherein the first anti-cavitation channel is substantially bilaterally symmetrical with the second anti-cavitation channel about a plane of symmetry containing the connecting line and the first cylinder centerline.

5. The engine block assembly of claim 3, wherein the water jacket has an area of maximum flow restriction in the section plane; and wherein the area of maximum flow restriction is located between the first anti-cavitation channel and the second anti-cavitation channel in the section plane.

6. The engine block assembly of claim 3, wherein the first inter-cylinder wall section has minimum wall thicknesses, as taken in the section plane, located substantially at:

a first juncture between the non-channeled central region and the first anti-cavitation channel; and a second juncture between the non-channeled central region and the second anti-cavitation channel.

7. An engine block assembly utilized within a liquid-cooled engine, the engine block assembly comprising:

an anti-cavitation engine block comprising:

a first cylinder having a first cylinder centerline;

a second cylinder having a second cylinder centerline;

a first inter-cylinder wall section located between the first cylinder and the second cylinder, as taken along a longitudinal axis perpendicular to the first cylinder centerline and to the second cylinder centerline; and a first plurality of anti-cavitation channels formed in the first inter-cylinder wall section;

a cylinder liner inserted into the first cylinder and having an outer circumferential surface toward which the first plurality of anti-cavitation channels opens; and a water jacket extending at least partially around the outer circumferential surface of the cylinder liner, the first plurality of anti-cavitation channels increasing local radial thicknesses of the water jacket to deter cavitation within the water jacket and adjacent the cylinder liner during operation of the liquid-cooled engine;

wherein the first cylinder has a cylinder radius, as taken in a section plane orthogonal to the first cylinder centerline; and wherein the first plurality of anti-cavitation channels each have a radius of curvature less than the cylinder radius, as taken in the section plane.

8. The engine block assembly of claim 7, wherein the first inter-cylinder wall section has a minimum wall thickness, as taken in the section plane, less than the radius of curvature.

9. The engine block assembly of claim 1, further comprising:

a third cylinder;

a second inter-cylinder wall section located between the first cylinder and the third cylinder, as taken along the longitudinal axis; and a second plurality of anti-cavitation channels formed in the second inter-cylinder wall section.

10. An engine block assembly utilized within a liquid-cooled engine, the engine block assembly comprising:

an anti-cavitation engine block comprising:

a first cylinder having a first cylinder centerline;

a second cylinder having a second cylinder centerline;

a third cylinder;

a first inter-cylinder wall section located between the first cylinder and the second cylinder, as taken along a longitudinal axis perpendicular to the first cylinder centerline and to the second cylinder centerline;

a second inter-cylinder wall section located between the first cylinder and the third cylinder, as taken along the longitudinal axis;

a first plurality of anti-cavitation channels formed in the first inter-cylinder wall section; and a second plurality of anti-cavitation channels formed in the second inter-cylinder wall section;

a cylinder liner inserted into the first cylinder and having an outer circumferential surface toward which the first plurality of anti-cavitation channels opens; and a water jacket extending at least partially around the outer circumferential surface of the cylinder liner, the first plurality of anti-cavitation channels increasing local radial thicknesses of the water jacket to deter cavitation within the water jacket and adjacent the cylinder liner during operation of the liquid-cooled engine;

wherein the first plurality of anti-cavitation channels comprises first and second anti-cavitation channels; and wherein the second plurality of anti-cavitation channels comprise third and fourth anti-cavitation channels substantially aligned with the first and second anti-cavitation channels, respectively, along axes parallel to the longitudinal axis.

11. The engine block assembly of claim 1, wherein the inter-cylinder wall section has a first side facing the first cylinder and has a second, opposing side facing the second cylinder;

wherein the first plurality of anti-cavitation channels is formed in the first side of the first inter-cylinder wall section; and wherein the anti-cavitation engine block further comprises a second plurality of anti-cavitation channels formed in the second, opposing side of the first inter-cylinder wall section.

12. The engine block assembly of claim 1, wherein the first plurality of anti-cavitation channels each have a maximum channel width, as taken in a section plane orthogonal to the first cylinder centerline; and wherein the first plurality of anti-cavitation channels each have a maximum channel length measured along an axis parallel to the first cylinder centerline, the maximum channel length exceeding the maximum channel width.

13. The engine block assembly of claim 1, wherein the first plurality of anti-cavitation channels each span a maximum thrust displacement region of the cylinder liner, as taken axially along the first cylinder centerline.

14. An engine block assembly utilized within a liquid-cooled engine, the engine block assembly comprising:

an anti-cavitation engine block having an engine block body comprising:

a plurality of cylinders having cylinder centerlines and spaced along a longitudinal axis perpendicular to the cylinder centerlines; and inner block walls of the engine block body bounding outer peripheries of the plurality of cylinders;

cylinder liners inserted into the plurality of cylinders and having targeted surface regions susceptible to cavitation damage during operation of the engine block assembly; and anti-cavitation channels configured as axially-elongated trenches cut into the inner block walls at locations adjacent the targeted surface regions of the cylinder liners.

15. The engine block assembly of claim 14, wherein the inner block walls comprise inter-cylinder wall sections interspersed with the plurality of cylinders along the longitudinal axis; and wherein at least a subset of the anti-cavitation channels is formed in the inter-cylinder wall sections.

16. The engine block assembly of claim 15, wherein the inter-cylinder wall sections have minimum wall thicknesses adjacent the anti-cavitation channels.

17. The engine block assembly of claim 15, wherein the anti-cavitation channels are formed adjacent at least one of (i) forward portions of the cylinder liners and (ii) aft portions of the cylinder liners.

18. An anti-cavitation engine block utilized within a liquid-cooled engine, the anti-cavitation engine block comprising:

a first cylinder having a first cylinder centerline;

a second cylinder having a second cylinder centerline;

a first inter-cylinder wall section located between the first cylinder and the second cylinder, as taken along a longitudinal axis perpendicular to the first cylinder centerline and to the second cylinder centerline; and a first plurality of anti-cavitation channels formed in the first inter-cylinder wall section, the first plurality of anti-cavitation channels increasing local thicknesses of a water jacket to deter cavitation within the water jacket during operation of the liquid-cooled engine, the water jacket defined by inner peripheral surfaces of the first cylinder and an outer circumferential surface of a cylinder liner when inserted into the first cylinder;

wherein the first plurality of anti-cavitation channels comprises:

a first anti-cavitation channel formed in the first inter-cylinder wall section and located on a first side of a connecting line extending from the first cylinder centerline to the second cylinder centerline, as taken in a section plane orthogonal to the first cylinder centerline; and a second anti-cavitation channel formed in the first inter-cylinder wall section and located on a second, opposing side of the connecting line.

* * * * *